United States Patent [19]

Wessel

[11] 4,227,503

[45] Oct. 14, 1980

[54] FUEL SUPPLY SYSTEM

[75] Inventor: Wolf Wessel, Oberriexingen, Fed. Rep. of Germany

[73] Assignee: Robert Bosch GmbH, Stuttgart, Fed. Rep. of Germany

[21] Appl. No.: 53,564

[22] Filed: Jun. 29, 1979

[30] Foreign Application Priority Data

Aug. 16, 1978 [DE] Fed. Rep. of Germany ..... 2835710

[51] Int. Cl.[3] ..... F02M 57/04

[52] U.S. Cl. ..... 123/454; 123/452; 261/50 A

[58] Field of Search ..... 123/139 AW, 139 BG, 123/140 FG, 140 MC; 261/50 A

[56] References Cited

U.S. PATENT DOCUMENTS

| | | | |
|---|---|---|---|
| 3,823,696 | 7/1974 | Mutschler | 123/139 AW |
| 3,880,125 | 4/1975 | Kammerer | 123/139 AW |
| 4,058,100 | 11/1977 | Tanaka | 123/139 AW |
| 4,125,102 | 11/1978 | Tanaka | 123/139 AW |
| 4,174,692 | 11/1979 | Wessel | 123/139 AW |
| 4,174,693 | 11/1979 | Steinwart | 123/139 AW |
| 4,182,298 | 1/1980 | Greiner | 123/139 AW |

*Primary Examiner*—Charles J. Myhre
*Assistant Examiner*—Carl Stuart Miller
*Attorney, Agent, or Firm*—Edwin E. Greigg

[57] ABSTRACT

A fuel supply system for mixture-comprising, externally ignited internal combustion engines is proposed, which serves to apportion a fuel quantity corresponding to the induced air quantity. The fuel supply system includes an air flow rate meter disposed in the air intake line which actuates a fuel apportionment valve in accordance with the induced air quantity. The restoring force of the air flow rate meter is effected by a control element which is acted upon by pressure fluid, whereby the control element and the pressure control valve each have an air chamber separated from a fuel chamber by a yielding element and in each fuel chamber the same fuel pressure upstream of the fuel apportionment valve and in each air chamber the same pressure in the air intake line upstream of the air flow rate meter prevails as is also effective downstream of the fuel apportionment valve.

6 Claims, 2 Drawing Figures

FUEL SUPPLY SYSTEM

BACKGROUND OF THE INVENTION

The invention relates to a fuel supply system as described herein and finally claimed. A fuel supply system is already known in which, imprecision on the part of the pressure control valve which controls the pressure of the pressure fluid causes undesirable variations in the restoring force. It is also known to provide a pressure control valve in the fuel supply line, at which valve the fuel pressure upstream of the fuel apportionment valve prevails on one side and the air pressure upstream of the air flow rate meter prevails on the otherside. It is further known to supply air to the apportioned fuel downstream of the fuel apportionment valve, under the pressure of the air intake line upstream of the air flow rate meter.

OBJECT AND SUMMARY OF THE INVENTION

The fuel supply system in accordance with the invention has the advantage over the prior art in that compensation is provided for imprecision on the part of the pressure control valve.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
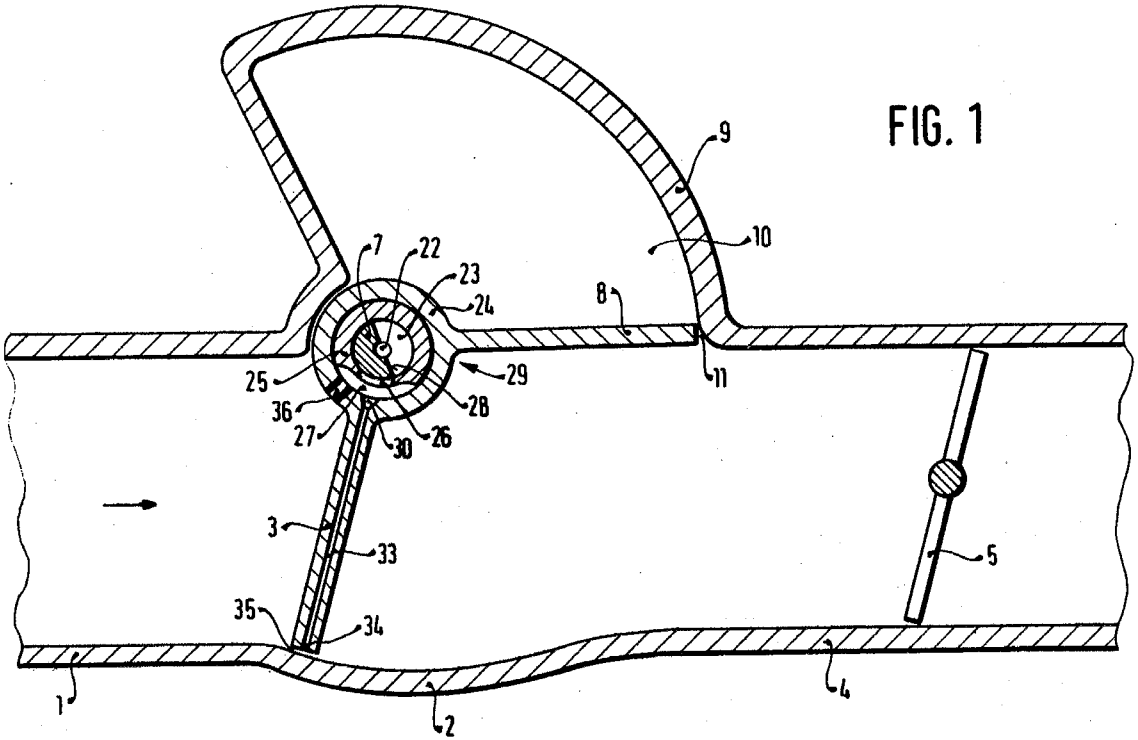
FIG. 1 is a section through a fuel supply system along the line I—I of FIG. 2.

Turning now to the drawings in the fuel supply system shown in FIG. 1, the air required for combustion flows in the direction of the arrow into an air intake conduit 1, which has a section 2 having an air flow rate meter disposed therein embodied as a baffle valve 3, and flows further through a section 4 having an arbitrarily actuatable throttle valve 5 to one or more cylinders, not shown, of a mixture-compressing, externally ignited internal combustion engine. The air flow rate meter embodied as a baffle valve 3 moves within the suitably contoured section 2 of the air intake conduit 1 as an approximately linear function of the air quantity flowing through the air intake line, where with a constant air pressure prevailing before the air flow rate meter 3, the pressure prevailing between air flow rate meter and throttle valve 5 also remains substantially constant. The air flow rate meter 3 is supported pivotably about a rigid bearing shaft 7 disposed transverse to the air intake conduit and is provided with a damping valve 8. The damping valve 8, upon an opening movement of the air flow rate meter 3, swings into a damping section 9 of the air intake conduit. The chamber 10 formed by the damping valve 8 and the damping section 9 communicates, via a small gap 11 provided between the front face of the damping valve 8 and the damping section 9, with the air intake conduit downstream of the air flow rate meter 3. As a result of the damping valve 8 it is assured that the pressure fluctuations in the intake manifold caused by intake strokes have practically no effect on the angular position of the air flow rate meter 3.

Figure 2:
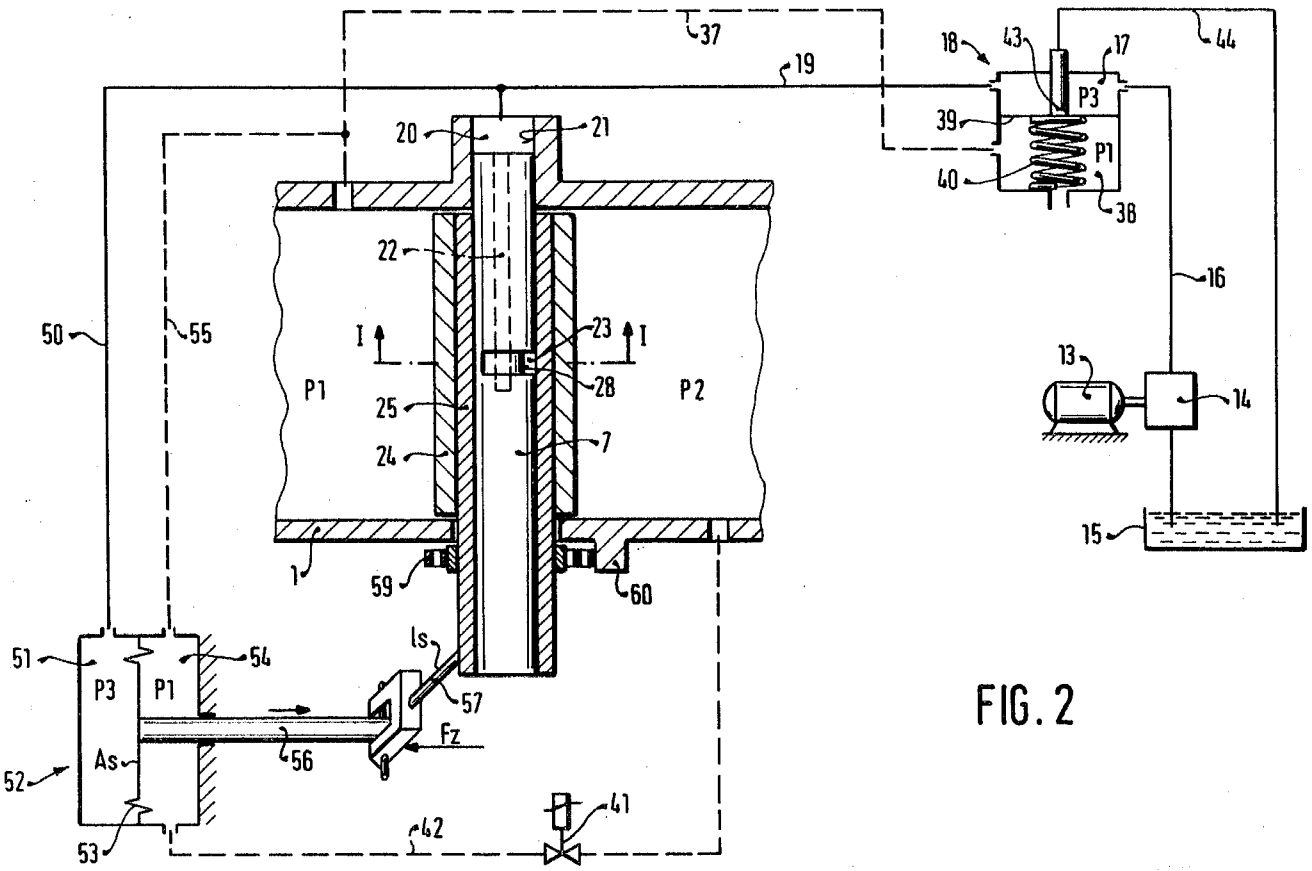
FIG. 2 is a plan view of the fuel supply system.

As is shown in FIG. 2, the fuel supply takes place by means of a fuel pump 14 driven by an electromotor 13 which induces fuel from a fuel container 15 and supplies it via a fuel supply line 16 to a fuel chamber 17 of a pressure control valve 18. From the fuel chamber 17, the fuel proceeds via a conduit 19 into a chamber 20, which is defined by the front face of the bearing shaft 7 and the guide bore 21 of the bearing shaft. The chamber 20 communicates via a bore 22, shown in broken lines in FIG. 2, with a control groove 23 cut into the bearing shaft 7.

The air flow rate meter 3 (see FIG. 1 again) and the damping valve 8 are disposed on a bearing hub 24 which is firmly connected with a sleeve 25 rotatable on the bearing shaft 7. A control slit 26 is cut into the sleeve 25, which discharges into a groove 27 of the sleeve 25. The control slit 26 cooperates with a control edge 28 which is formed by the limitation surface of the control groove 23, the limitation surface being formed in turn by the bearing shaft. By means of the control edge 28, the control slit 26 is opened more or less widely depending on the position of the air flow rate meter 3, so that a quantity of fuel can be apportioned which is in a certain proportion to the quantity of air induced by the internal combustion engine. The control edge 28 and control slit 26 comprise a fuel apportionment valve 29 which is disposed in the bearing shaft 7 of the air flow rate meter 3. The apportioned fuel proceeds via the groove 27 into a conical inlet section 30, which discharges at its smaller end into an injection line 33 that is disposed in the shaft of the air flow rate meter 3. The injection line 33 in turn discharges at the front face of the air flow rate meter 3 via an injection nozzle 34 into the gap 35 of the highest air velocity between the front face and the wall of the air intake line section 2. The groove 27 communicates via an air aperture 36 with the air intake conduit 1 upstream of the air flow rate meter 3, so that downstream of the fuel apportionment point, as a counterpressure, the air intake line pressure prevails upstream of the air flow rate meter 3. The injection line 33 may also communicate with a plurality, not shown, of injection nozzles 34 disposed in the front face of the air flow rate meter 3. Also, an injection gap which extend over nearly the entire width of the front face of the air flow rate meter 3 may serve as the injection nozzle 34. Furthermore, the injection nozzle 34 could be replaced by an injection valve, however this is not shown.

The apportionment of the fuel at the fuel apportionment valve 29 takes place at a substantially constant pressure differential. To this end, an air chamber 38 (see FIG. 2) separated from the fuel chamber 17 of the pressure control valve 18 by a diaphragm 39 which functions as the yielding member communicates, via an air line 37 indicated in broken lines, with the air intake conduit 1 upstream of the air flow rate meter 3, so that the same pressure prevails in the air chamber 38 as that downstream of the control slit 26. The pressure control valve 18 is urged in the closing direction by a spring 40, which is disposed in the air chamber 38.

The pressure control valve is embodied as a flat seat valve, with the diaphragm 39 as the movable valve element and a rigid valve seat 43, through which fuel can proceed into a return flow line 44, which discharges into the fuel container 15.

As shown in FIG. 1, the groove 27 communicates with an air aperture 36 which discharges into the air intake conduit 1 upstream of the flow rate meter 3. The application of the intake tube pressure upstream of the air flow rate meter, via the air aperture 36, as a counterpressure at the apportionment location has the further advantage, in addition to providing preliminary preparation of the apportioned fuel with air, first, that the system can operate with an open injection nozzle and, second, that the control of a constant differential pressure at the apportionment location can be made simpler.

The deflection of the air flow rate meter 3 occurs against a restoring force generated by pressure fluid. To this end, a pressure line branches off from the fuel supply line 16, 19 which discharges into a fuel chamber 51 of a control element 52. The fuel chamber 51 of the control element is separated by a diaphragm 53 which serves as the yielding member from an air chamber 54, which communicates via an air line 55, indicated by broken lines, with the intake line section upstream of the air flow rate meter 3. An actuation rod 56 that is secured to the diaphragm 53 which engages a lever 57 is connected to the sleeve 25 of the air flow meter 3. The restoring moment generated by the control element 52 acts counter to the opening moment engaging the air flow rate meter 3. The restoring force on the air flow rate meter 3 may be varied in accordance with operating characteristics of the internal combustion engine. To this end there may be an electromagnetic valve 41, for example, which is disposed in an air line 42 between the air chamber 54 and the air intake conduit 4, or a supplemental force $F_z$ dependent on operating characteristics may be exerted, for example, on the lever 57. The electromagnetic valve 41 may be controlled, for example, in accordance with the signal of an oxygen sensor disposed in the exhaust gas line of the internal combustion engine, so that the air pressure in the air chamber 54 can be influenced to a greater or lesser extent.

The following mathematical relationships result:

For the induced air quantity $Q_L$, with an air surface area $A_L$ opened by the air flow rate meter 3, a pressure $p_1$ in the air intake line 1 upstream of the air flow rate meter and a pressure $p_2$ in section 2 of the air intake line, $$Q_L = A_L \cdot p_1 - p_2.$$

For the fuel quantity $Q_K$ apportioned at the fuel apportionment valve 29, with a fuel apportionment surface area $A_K$ and a fuel pressure $p_3$, $$Q_K = A_K \cdot p_3 - p_1.$$

For the fuel-air ratio which corresponds to the air number lambda, then $$Q_L/Q_K = k \cdot (p_1 - p_2)/(p_3 - p_1) \quad (1)$$

with k as a factor.

The opening force $F_o$ exerted on the air flow rate meter is determined to be $$F_o = A_F \cdot (p_1 - p_2),$$

with $A_F$ as the perpendicular projection of the air flow rate meter surface area 3 to the air flow direction. For the opening moment $M_o$ exerted on the air flow rate meter 3, then $$M_o = F_o \cdot l_o,$$

with $l_o$ as the effective lever arm for the opening force $F_o$.

For the closing moment $M_s$ acting counter to the opening moment $M_o$, $$M_s = A_s \cdot (p_3 - p_1) \cdot l_s,$$

with $A_s$ as the surface area of the diaphragm 53 and $l_s$ as the effective length of the lever 57.

In the balanced case, the opening moment $M_o = M_s$, which produces $$p_1 - p_2 = (p_3 - p_1) A_s \cdot l_s / A_F \cdot l_o. \quad (2)$$

If equation (2) is substituted into equation (1), the result is $$Q_L/Q_K = A_L/A_K \cdot A_s \cdot l_s / A_F \cdot l_o.$$

This means that the air number lambda is entirely independent of the fuel pressure; that is, it is fixed only by the geometric values and there needs to be no requirement for precision placed on the pressure control valve 18.

It may be advantageous not to apply the entire restoring force hydraulically, but rather to provide a small portion by means of a correction spring 59, which engages the sleeve 25 and is connected on its other end with a stub 60 attached to the housing. The disposition of the soft correction spring 59 enables compensation for geometric tolerances such as those of the fuel apportionment slit 26.

The mode of operation of the fuel supply system is as follows:

When the internal combustion engine is running, fuel is induced by means of the fuel pump 14 driven by the electromotor 13 out of the fuel container 15 and supplied via the line 16 to the fuel apportionment valve 29. At the same time, the internal combustion engine induces air via the air intake conduit 1, by means of which the air flow rate meter 3 undergoes a certain amount of deflection out of its position of rest. In accordance with the amount of deflection of the air flow rate meter 3, the control slit 26 opens more or less widely with respect to the control edge 38. The direct control of the fuel apportionment valve by the air flow rate meter 3 produces a relationship between induced air quantity and apportioned fuel quantity which is constant at any given time. The apportionment takes place at a pressure difference held substantially constant at any given time by the pressure control valve 18. The injection of the apportioned fuel takes place via the injection nozzle 34 at the front face of the air flow rate meter 3 into the gap 35 between the front face of the air flow rate meter 3 and the wall of the air conduit section 2, that is, at the point of highest air velocity, in order to attain the most homogeneous possible fuel-air mixture.

The foregoing relates to a preferred embodiment of the invention, it being understood that other embodiments and variants thereof are possible within the spirit and scope of the invention, the latter being defined by the appended claims.

What is claimed and desired to be secured by letters patent of the United States is:

1. A fuel supply system for mixture-compressing, externally ignited internal combustion engines having an air intake conduit, in which an air flow rate meter and an arbitrarily actuatable throttle valve are disposed in sequence and the air flow rate meter is moved against a restoring force in accordance with the quantity of air passing therethrough to thereby adjust the movable part of a valve disposed in the fuel supply line for the apportionment of a quantity of fuel proportional to the quantity of air and in which said restoring force is generated by means of pressure fluid which being under substantially constant pressure continuously acts upon a control element operatively connected with the air flow rate meter to effect the restoring force with said pressure fluid being controllable by means of at least one pressure control valve, further wherein each said control element and said pressure control valve includes an air chamber separated from a fuel chamber by a yielding member with each said fuel chamber being subjected to the same fuel pressure upstream of said fuel apportionment valve and each said air chamber subjected to the same pressure in the air intake line upstream of the air flow rate meter.

2. A fuel supply system in accordance with claim 1, further wherein said yielding member includes a diaphragm capsule having a diaphragm, said diaphragm coupled to the air flow rate meter and arranged to effect the restoring force.

3. A fuel supply system in accordance with claim 2, further wherein said air flow rate meter is pivotable about a bearing shaft and said control element engages the bearing shaft via a lever means.

4. A fuel supply system in accordance with claim 1, further wherein a portion of said restoring force is generated by means of a soft spring.

5. A fuel supply system in accordance with claim 1, further wherein said restoring force effected by the control element can be influenced by a supplementary force ($F_z$) which is dependent on the operating characteristics of the internal combustion engine.

6. A fuel supply system in accordance with claim 1, further wherein said air chamber of said control element communicates via an air line downstream of the air flow rate meter and said air line including an electromagnetic valve controllable in accordance with the operating characteristics of the internal combustion engine.

* * * * *